US008141957B2

(12) United States Patent
McClung et al.

(10) Patent No.: US 8,141,957 B2
(45) Date of Patent: Mar. 27, 2012

(54) CUSHION WITH PLURAL ZONES OF FOAM

(75) Inventors: Mark D. McClung, Grandview, TN (US); Theodore R. McClure, Richmond, VA (US); Steven D. Hawkins, Midlothian, VA (US)

(73) Assignee: La-Z-Boy Incorporated, Monroe, MI (US)

( * ) Notice: Subject to any disclaimer, the term of this patent is extended or adjusted under 35 U.S.C. 154(b) by 277 days.

(21) Appl. No.: 12/334,767

(22) Filed: Dec. 15, 2008

(65) Prior Publication Data

US 2010/0148562 A1 Jun. 17, 2010

(51) Int. Cl.
*A47C 7/02* (2006.01)

(52) U.S. Cl. ..... 297/452.27; 5/740; 5/727

(58) Field of Classification Search ..... 297/452.27; 5/740, 727, 653

See application file for complete search history.

(56) References Cited

U.S. PATENT DOCUMENTS

| | | | | |
|---|---|---|---|---|
| 3,278,955 | A * | 10/1966 | Freedlander et al. | 5/655.9 |
| 3,833,259 | A | 9/1974 | Pershing | |
| 3,987,507 | A | 10/1976 | Hall | |
| 4,190,697 | A | 2/1980 | Ahrens | |
| 4,379,856 | A | 4/1983 | Samaritter et al. | |
| 4,405,681 | A | 9/1983 | McEvoy | |
| 4,522,447 | A | 6/1985 | Snyder et al. | |
| 4,682,818 | A * | 7/1987 | Morell | 297/452.27 |
| 4,753,480 | A * | 6/1988 | Morell | 297/452.27 |
| 4,755,411 | A | 7/1988 | Wing et al. | |
| 4,819,288 | A | 4/1989 | Lowthian | |
| 4,837,881 | A | 6/1989 | Kondo et al. | |
| 4,951,334 | A * | 8/1990 | Maier | 5/653 |
| 5,018,790 | A * | 5/1991 | Jay | 297/452.26 |
| 5,137,333 | A | 8/1992 | Chee | |
| 5,294,181 | A * | 3/1994 | Rose et al. | 297/452.25 |
| 5,327,596 | A | 7/1994 | Wallace | |
| 5,442,823 | A | 8/1995 | Siekman et al. | |
| 5,474,362 | A | 12/1995 | Albecker, III | |
| 5,632,053 | A * | 5/1997 | Weingartner et al. | 5/655.9 |
| 6,175,980 | B1 * | 1/2001 | Gaither | 5/654 |
| 6,202,239 | B1 * | 3/2001 | Ward et al. | 5/727 |
| 6,237,173 | B1 * | 5/2001 | Schlichter et al. | 5/722 |
| 6,269,504 | B1 * | 8/2001 | Romano et al. | 5/690 |
| 6,286,166 | B1 * | 9/2001 | Henley et al. | 5/722 |

(Continued)

FOREIGN PATENT DOCUMENTS

DE 4140935 A1 * 7/1993

(Continued)

OTHER PUBLICATIONS

International Search Report for International Application No. PCT/US2009/065136 mailed Jul. 1,2010.

(Continued)

*Primary Examiner* — David Dunn
*Assistant Examiner* — David E Allred

(57) ABSTRACT

A cushion assembly defining a thickness direction comprises at least one covering layer and a core layer. The core layer comprises a first member and a second member. The covering layer spans continuously across both the first and second members in a direction generally transverse to the thickness direction, and the first member is disposed adjacent a forward area of the cushion assembly. The second member is disposed adjacent a back surface of the first member. The second member has a higher resistance to resilient deformation than the first member, and the first member has a higher resistance to resilient deformation than the at least one covering layer.

11 Claims, 2 Drawing Sheets

U.S. PATENT DOCUMENTS

| | | | | |
|---|---|---|---|---|
| 6,292,965 | B1 * | 9/2001 | Gambrell | 5/716 |
| 6,336,681 | B1 * | 1/2002 | Crosbie | 297/452.27 |
| D456,197 | S * | 4/2002 | McClure et al. | D6/596 |
| 6,516,483 | B1 * | 2/2003 | VanSteenburg | 5/737 |
| 6,701,556 | B2 * | 3/2004 | Romano et al. | 5/653 |
| 6,807,698 | B2 * | 10/2004 | Torbet et al. | 5/727 |
| 6,918,146 | B2 * | 7/2005 | England | 5/653 |
| 6,952,852 | B2 * | 10/2005 | Reeder et al. | 5/727 |
| 6,957,465 | B1 * | 10/2005 | Oprandi | 5/727 |
| 7,238,630 | B2 | 7/2007 | Steagall et al. | |
| 7,905,552 | B2 * | 3/2011 | Galbreath et al. | 297/452.27 |
| 8,020,230 | B2 * | 9/2011 | Rawls-Meehan | 5/740 |
| 2006/0272098 | A1 * | 12/2006 | Hochschild | 5/727 |
| 2006/0273650 | A1 * | 12/2006 | Embach | 297/452.27 |
| 2006/0288490 | A1 * | 12/2006 | Mikkelsen et al. | 5/740 |
| 2007/0022540 | A1 * | 2/2007 | Hochschild | 5/727 |
| 2007/0044241 | A1 * | 3/2007 | Clark | 5/655.9 |
| 2007/0209120 | A1 | 9/2007 | Clark | |
| 2011/0239374 | A1 * | 10/2011 | Rawls-Meehan | 5/740 |
| 2011/0252569 | A1 * | 10/2011 | Rawls-Meehan | 5/693 |
| 2011/0258784 | A1 * | 10/2011 | Rawls-Meehan | 5/740 |
| 2011/0277246 | A1 * | 11/2011 | Willingham | 5/653 |
| 2011/0283462 | A1 * | 11/2011 | Rawls-Meehan | 5/740 |

FOREIGN PATENT DOCUMENTS

| | | | |
|---|---|---|---|
| GB | 2244000 | A * | 11/1991 |
| JP | 07-317286 | A | 12/1995 |
| WO | WO 8102384 | A1 * | 9/1981 |

OTHER PUBLICATIONS

Written Opinion of the International Searching Authority for International Application No. PCT/US2009/065136 mailed Jul. 1, 2010.

* cited by examiner

FIG 1
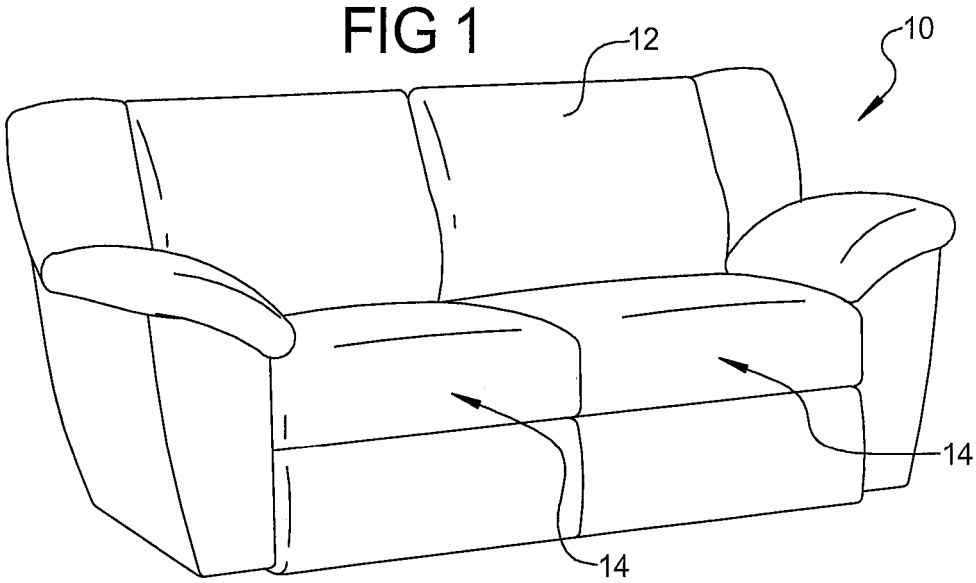
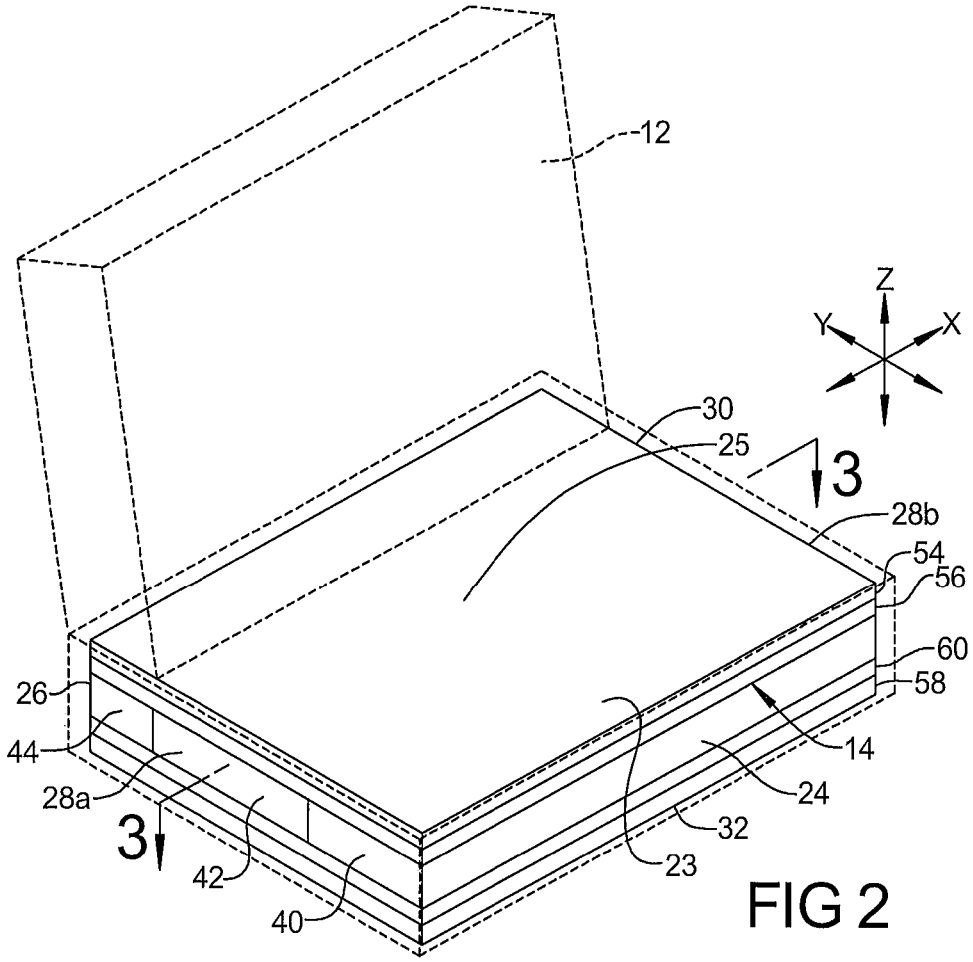
FIG 2

FIG 3
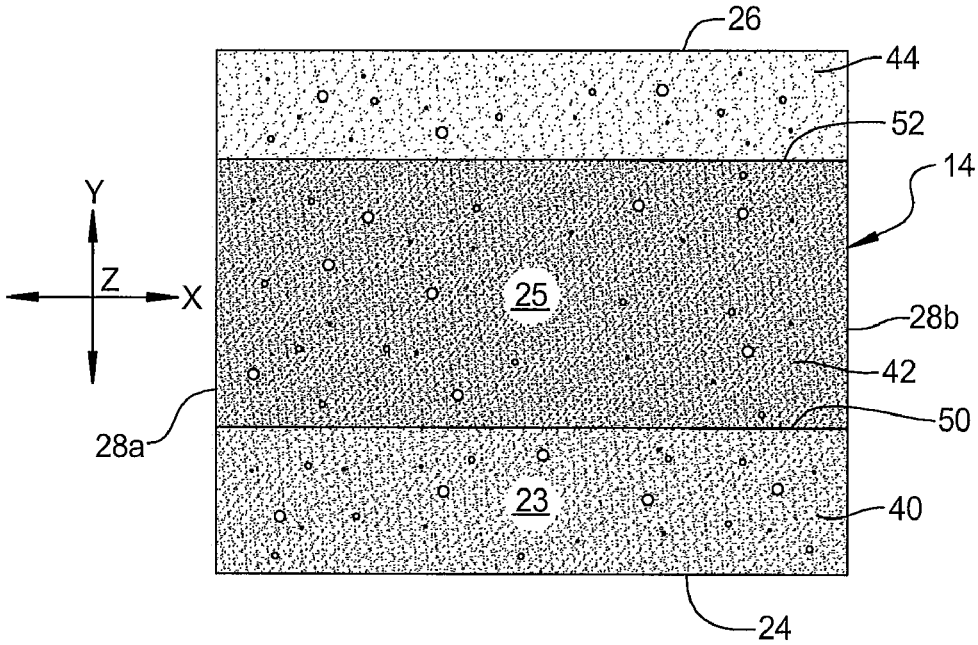
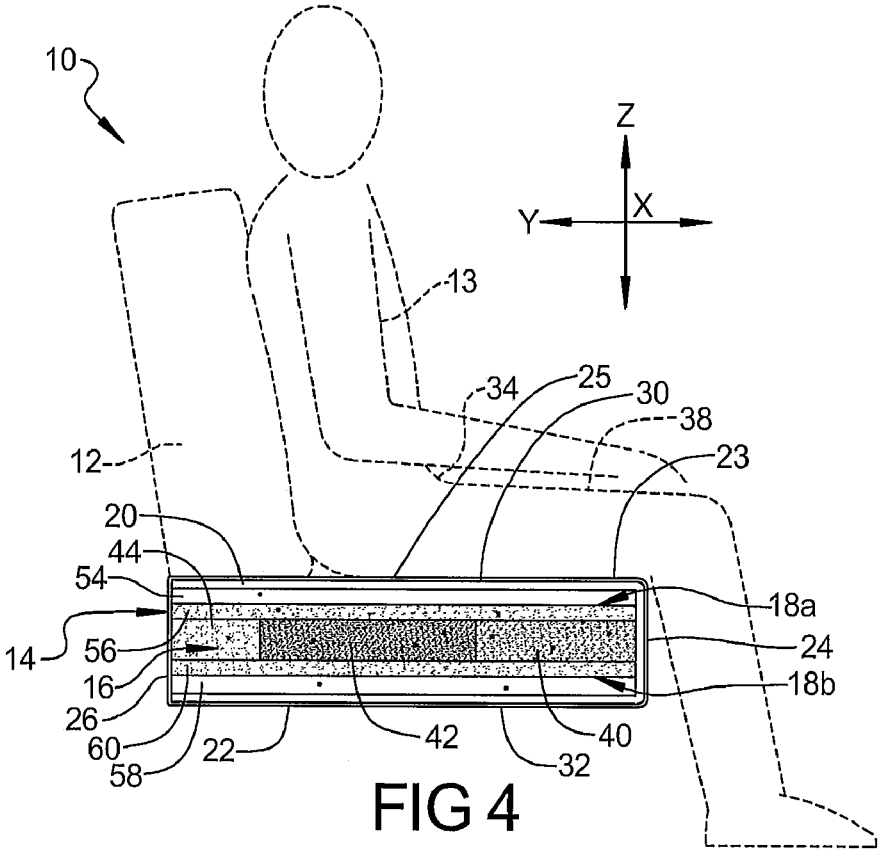
FIG 4

CUSHION WITH PLURAL ZONES OF FOAM

FIELD

The present disclosure relates to a seating cushion and, more particularly, to a seating cushion with plural zones of foam.

BACKGROUND

This section provides background information related to the present disclosure which is not necessarily prior art.

Furniture can include one or more cushions for providing cushioned support of a person seated on the furniture. For instance, couches, sofas, loveseats, chairs, and the like often include seat cushions. These cushions are typically made of resiliently deformable material, such as foam, and can be encased within upholstery and the like. The cushions can thus deform to the shape of the seated person, and yet provide sufficient firmness to support the person comfortably and facilitate the person moving off of the piece of furniture.

Typically, cushions include one or more overlapping layers of compressible material. Thus, in the direction of the weight applied by the seated person, the cushion typically has a uniform resistance to resilient deformation. However, because different areas of the seated person's body apply varying amounts of weight or pressure to the cushion, the cushion may deform in an undesirable manner.

For instance, the seated person's hip area might be supported by a central area of the cushion, and the person's lower thighs might be supported by a forward area of the cushion. Also, the seated person's hip area might apply more pressure due to the cushion than the person's lower thighs due to the difference in weight of these respective body portions. Accordingly, the central portion of the cushion might be compressed more than the forward end, especially when the person has been seated for an extended period of time. This condition can cause an uncomfortable amount of upward pressure to be exerted by the forward area of the cushion onto the person's lower thighs. Also, the person could become uncomfortable while seated on the cushion as the central area is compressed more or sinks deeper than surrounding areas of the cushion because it can become difficult to sit upright. Furthermore, the person may have difficulty adjusting his or her position and/or moving off of the cushion because the hip area of the seated person has sunk deeper into the central area of the cushion than the lower thighs have sunk into surrounding areas of the cushion.

SUMMARY

This section provides a general summary of the disclosure, and is not a comprehensive disclosure of the full scope or all features of the disclosure.

A cushion assembly defining a thickness direction is disclosed that includes at least one covering layer and a core layer. The core layer includes a first member and a second member. The covering layer spans continuously across both the first and second members in a direction generally transverse to the thickness direction, and the first member is disposed adjacent a forward area of the cushion assembly. The second member is disposed adjacent a back surface of the first member. The second member has a higher resistance to resilient deformation than the first member, and the first member has a higher resistance to resilient deformation than the at least one covering layer.

Furthermore, a method of manufacturing a cushion assembly is disclosed that includes arranging a first member of a core layer relative to a second member of the core layer such that the second member is disposed adjacent a back surface of the first member and the first member of the core member is disposed adjacent a forward area of the cushion assembly. Furthermore, the method includes covering the core layer with at least one covering layer such that the covering layer spans continuously across both the first and second members in a direction generally transverse to a thickness direction of the cushion assembly. The second member has a higher resistance to resilient deformation than the first member, and the first member has a higher resistance to resilient deformation than the covering layer. Moreover, the method includes encapsulating the core layer and the covering layer in a jacket.

Moreover, a cushion assembly for a piece of furniture to provide cushioned support of a seated person is disclosed. The cushion assembly includes an upper covering layer including a foam material, a lower covering layer including a foam material, and a core layer. The core layer includes a first member and a second member, each member comprising a foam material. The upper and lower covering layers each span continuously across both the first and second members in a direction generally transverse to the thickness direction such that the first and second members are disposed between and abut the upper and lower covering layers. The first member is disposed adjacent a forward area of the cushion assembly to support a lower thigh area of the seated person, and the second member abuts a back surface of the first member to support a hip area of the seated person. The second member has a higher resistance to resilient deformation than the first member, and the first member has a higher resistance to resilient deformation than the upper and lower covering layers.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a perspective view of a piece of furniture with a cushion assembly according to various teachings of the present disclosure;

FIG. 2 is a perspective view of a portion of the cushion assembly of FIG. 1;

FIG. 3 is a top, sectional view of a core member of the cushion assembly taken from the line 3-3 of FIG. 2; and FIG. 4 is a sectional side view of the cushion assembly of FIG. 1.

Corresponding reference numerals indicate corresponding parts throughout the several views of the drawings.

DETAILED DESCRIPTION

Example embodiments will now be described more fully with reference to the accompanying drawings.

Referring initially to FIGS. 1 and 4, a piece of furniture 10 is illustrated according to various teachings of the present disclosure. The illustrated embodiment of the furniture 10 is a couch, loveseat, or sofa, but it will be appreciated that the furniture could be a chair or any other suitable piece of furniture 10 without departing from the scope of the present disclosure.

The furniture 10 generally includes a plurality of cushions, including a plurality of back cushions 12 for supporting a back of a seated person 13 (FIG. 4) and a plurality of seat cushion assemblies 14 for supporting the hips, thighs and/or other extremities of the person 13 (FIG. 4). Although the cushion assemblies 14 are discussed as being seat cushion assemblies 14, it will be appreciated that the cushion assemblies 14 could be located in any suitable position on the furniture 10 without departing from the scope of the present disclosure. As will be discussed in greater detail below, the cushion assemblies 14 are configured to provide a great deal of comfort for the seated person 13 and can help the person 13 adjust positions and/or move off of the cushion assembly 14.

Generally, as shown in FIG. 4, the cushion assembly 14 can include a core layer 16, a plurality of upper covering layers 18*a*, a plurality of lower covering layers 18*b*, and a filler layer 20, each of which will be described in greater detail below. The core layer 16 is disposed between the upper covering layers 18*a* and the lower covering layers 18*b*. The filler layer 20 at least partially surrounds the upper and lower covering layers 18*a*, 18*b* and the core layer 16. Also, these layers 16, 18*a*, 18*b*, 20 can be encapsulated within a jacket 22. The jacket 22 can be made of a known upholstery material and can include artistic designs, textures, and the like for adding to the look and feel of the cushion assembly 14.

Referring now to FIG. 2, the cushion assembly 14 will be discussed in greater detail. It will be appreciated that the back cushion 12 of the furniture 10 is shown in phantom for purposes of clarity. It will also be appreciated that the jacket 22 and filler layer 20 are also shown in phantom for purposes of clarity. For purposes of clarity, the cushion assembly 14 will be discussed in relation to a coordinate system X, Y, Z. The coordinate system X, Y, Z is arranged according to a thickness direction Z of the cushion assembly 14 and two transverse directions X, Y that are generally transverse (e.g., perpendicular) to the thickness direction Z. Specifically, the Y transverse direction extends generally forward and rearward on the cushion assembly 14, and the X transverse direction extends generally side to side on the cushion assembly 14.

As shown in the embodiments illustrated in FIG. 2, the cushion assembly 14 generally includes a forward area 23 that includes a forward end 24, a central area 25, and a rearward end 26. The central area 25 is generally rearward from the forward area 23 along the Y direction, and the rearward end 26 is rearward from the central area 25 along the Y direction. Furthermore, the assembly 14 includes a first and second transverse side 28*a*, 28*b*, which extend generally transverse along the Y direction relative to the forward area 23, the forward end 24, and the rearward end 26 on opposite sides thereof. Also, the cushion assembly 14 includes an upper side 30 and a lower side 32, which are opposite from each other along the thickness direction Z.

In the embodiments represented in FIG. 2, the cushion assembly 14 is generally rectangular and box-shaped. However, it will be appreciated that the cushion assembly 14 could be of any suitable shape without departing from the scope of the present disclosure. For instance, the cushion assembly 14 could be rounded, could include projections, and the like.

It will be appreciated that the person 13 typically sits on the upper side 30 and that the lower side 32 abuts a support frame, etc. (not shown) of the furniture 10 (FIG. 4). Specifically, a hip area 34 of the person 13 is typically disposed over and supported by the central area 25 of the cushion assembly 14, and a lower thigh area 38 of the person 13 is typically disposed over and supported by the forward area 23 and forward end 24 of the cushion assembly 14. As will be discussed in greater detail below, the forward and central areas 23, 25 of the cushion assembly 14 can be configured to provide improved support for the person 13.

Referring now to FIGS. 2, 3, and 4, an exemplary embodiment of the core layer 16 is illustrated in greater detail. The core layer 16 can include a first member 40, a second member 42, and a third member 44. In some exemplary embodiments, the members 40, 42, 44 can include and be made of foam. However, it will be appreciated that the members 40, 42, 44 can be made of any suitable, resiliently deformable material. As shown in FIG. 4, each of the members 40, 42, 44 can have substantially the same thickness in the Z direction. It will be appreciated, however, that the members 40, 42, 44 could have any suitable thickness and shape without departing from the scope of the present disclosure.

As is best illustrated in FIG. 3, the first member 40 can be elongate and rectangular, with a substantially straight axis extending along the X direction. In some embodiments, the first member 40 extends continuously between each of the transverse sides 28*a*, 28*b* of the cushion assembly 14. Also, as shown, the first member 40 can be disposed adjacent the forward area 23 and the forward end 24 of the cushion assembly 14, generally for supporting the lower thigh area 38 and/or lower legs of the person 13.

Moreover, the second member 42 can be elongate and rectangular, with a substantially straight axis extending along the X direction. In some embodiments, the second member 42 extends continuously between each of the transverse sides 28*a*, 28*b* of the cushion assembly 14. Also, as shown, the second member 42 can be disposed rearward (in the Y direction) relative to the first member 40. Specifically, in some embodiments, the second member 42 can be disposed adjacent to and abut a back surface 50 of the first member 40. Also, in some embodiments, the second member 42 can be fixedly coupled to the back surface 50 of the first member 40. The first and second members 40, 42 can be fixedly coupled using any suitable means, such as adhesive, chemical bonding, pile tape, and the like. Moreover, the second member 42 can be disposed adjacent and within the central area 25 of the cushion assembly 14, generally for supporting the hip area 34 of the person 13.

Still further, the third member 44 can be elongate and rectangular, with a substantially straight axis extending along the X direction. In some embodiments, the third member 44 extends continuously between each of the transverse sides 28*a*, 28*b* of the cushion assembly 14. Also, as shown, the third member 44 can be disposed rearward (in the Y direction) relative to the second member 42. Specifically, in some embodiments, the third member 44 can be disposed adjacent to and abut a back surface 52 of the second member 42. Also, in some embodiments, the third member 44 can be fixedly coupled to the back surface 52 of the second member 42. The second and third members 42, 44 can be fixedly coupled using any suitable means, such as adhesive, chemical bonding, pile tape, and the like. Moreover, the third member 44 can be disposed adjacent the rearward end 26 of the cushion assembly 14 such that the second member 42 is disposed between the first and third members 40, 44.

In some embodiments, the width of the third member 44 is such that the back cushion 12 of the furniture 10 substantially covers the third member 44 and such that the person 13 is less likely to be directly supported by the third member 44. Also, in some embodiments, the third member 44 is not included, and the second member 42 extends continuously from the back surface 50 of the first member 40 to the rearward end 26 of the cushion assembly 14.

As shown in FIGS. 2 and 4, the upper covering layer 18*a* can include a first upper covering layer 54 and a second upper covering layer 56, each of which have generally rectangular, flat, box-like shapes. Each of the first and second upper covering layers 54, 56 can be thinner than the core layer 16. The first and second upper covering layers 54, 56 can be made out of foam; however, it will be appreciated that the first and second upper covering layers 54, 56 can be made out of any suitable resiliently deformable material.

The first upper covering layer 54 can be disposed adjacent the upper side 30 of the cushion assembly 14 and can abut and overlap the second upper covering layer 56. Also, the second upper covering layer 56 can abut each of the first, second, and third members 40, 42, 44 of the core layer 16. As such, the first and second upper covering layers 54, 56 can span continuously across and collectively cover the first, second, and third members 40, 42, 44 of the core layer 16 in the X and Y transverse directions.

Likewise, the lower covering layer 18*b* can include a first lower covering layer 58 and a second lower covering layer 60, each of which have generally rectangular, flat, box-like shapes. Each of the first and second lower covering layers 58, 60 can be thinner than the core layer 16. The first and second lower covering layers 58, 60 can be made out of foam; however, it will be appreciated that the first and second lower covering layers 58, 60 can be made out of any suitable resiliently deformable material.

The first lower covering layer 58 can be disposed adjacent the lower side 32 of the cushion assembly 14 and can abut and overlap the second lower covering layer 60. Also, the second lower covering layer 58 can abut each of the first, second, and third members 40, 42, 44 of the core layer 16. As such, the first and second lower covering layers 58, 60 can span continuously across and collectively cover the first, second, and third members 40, 42, 44 of the core layer 16 in the X and Y transverse directions.

It will be appreciated that the covering layers 54, 56, 58, 60 could be fixedly coupled to each other and/or to the core layer 16 via any suitable means, such as adhesive, chemical bonding, pile tape, and the like. Also, it will be appreciated that the cushion assembly 14 could include any number of covering layers 18*a*, 18*b*. Moreover, it will be appreciated that the cushion assembly 14 could include only one of the upper and lower covering layers 18*a*, 18*b*. Furthermore, it will be appreciated that the upper covering layer 18*a* could include only one of the first and second upper covering layers 54, 56, and that the lower covering layer 18*b* could include only one of the first and second lower covering layers 58, 60.

Additionally, as illustrated in FIG. 4, the filler layer 20 can be a relatively thin sheet that continuously extends from the rearward end 26 of the upper side 30 of the cushion assembly 14, across the central area 25, across the forward end 24, and across the lower side 32 to the rearward end 26. The filler layer 20 can be made out of any suitable soft material. In some embodiments, the filler layer 20 can be made out of and include batting material (i.e., cotton, wool, or synthetic sheets) or feathers.

As discussed above, the core layer 16 and the upper and lower covering layers 18*a*, 18*b* can be made out of a resiliently deformable material, such as foam. It will be appreciated that these layers 16, 18*a*, 18*b* can be made out of any suitable foam, such as flexible, polyurethane foam.

The layers 16 can be configured to provide increased comfort for the person 13 seated on the cushion assembly 14. For instance, the second member 42 of the core layer 16 can have a higher resistance to resilient deformation than the first member 40. Thus, the central area 25 of the cushion assembly 14 (i.e., the area likely to support the most weight of the person 13) can provide firmer support for the person. Accordingly, the cushion assembly 14 is less likely to sag in the central area 25, thereby allowing the person 13 to remain sitting upright on the cushion assembly 14, to adjust his or her position, and to move off of the cushion assembly 14. Also, because the first member 40 of the core layer 16 is less firm, the cushion assembly 14 applies less pressure to the lower thigh area 38 of the person 13 for greater comfort.

Additionally, the first member 40 can have a higher resistance to resilient deformation than the third member 44. Also, the first member 40 can have a higher resistance to resilient deformation than any of the covering layers 54, 56, 58, 60. Accordingly, these characteristics can help distribute the weight loads of the person 13 to the core layer 16 for improved support.

In some embodiments, the resistance to resilient deformation is measured according to foam density and indentation force deflection (IFD) characteristics. These characteristics can be classified in a known manner, such as ASTM D3574.

Specifically, in some embodiments, the second member 42 has an indentation force deflection (IFD) characteristic above approximately 27 lb IFD, while the first member 40 has an IFD characteristic above approximately 24 lb IFD. For instance, in some embodiments, the second member 42 has a density of 2.5 pounds per cubic foot (pcf) and between 35 lb and 40 lb IFD, whereas the first member 40 has a density of approximately 1.8 pcf and between 25 lb and 30 lb IFD, Still further, in some embodiments, the first member 40 has a density of approximately 1.8 pcf and 27 lb IFD, the second member 42 has a density of approximately 2.5 pcf and 36 lb IFD, the third member 44 has a density of approximately 1.8 pcf and 23 lb IFD, the second upper covering layer 56 and the second lower covering layer each have a density of approximately 1.8 pcf and 24 lb IFD, and the first upper covering layer 54 and first lower covering layer 58 each have a density of approximately 1.8 pcf and 12 IFD.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

What is claimed is:

1. A cushion assembly defining a thickness direction comprising:

a covering layer;

a core layer including a first member and a second member, the first member disposed adjacent a forward area of the cushion assembly, and the second member disposed rearward relative to the first member, the covering layer at least partially lying over each of the first member and the second member in the thickness direction and extending continuously between opposed transverse sides of the cushion assembly, the second member having an indentation force deflection characteristic between approximately 35 lb to 40 lb IFD defining a higher resistance to resilient deformation than the first member, and the first member having a higher resistance to resilient deformation than the covering layer, a central area of the cushion assembly covered by the covering layer positioned directly above the second member, and the forward area of the cushion assembly covered by the covering layer positioned directly above the first member; and the core layer further including a third member positioned rearward of the second member, a width of the third member selected such that a back cushion of a furniture member substantially covers the third member, the first member having a higher resistance to resilient deformation than the third member and the third member having a higher resistance to resilient deformation than the covering layer.

2. The cushion assembly of claim 1, wherein the covering layer is spaced apart at a distance from the second member.

3. The cushion assembly of claim 1, wherein the first member and the second member are each elongate with a longitudinal axis that extends in a width direction of the cushion assembly.

4. The cushion assembly of claim 1, wherein at least one of the first member and the second member has a generally rectangular cross section taken in a plane that is substantially perpendicular to a width direction of the cushion assembly.

5. The cushion assembly of claim 1, wherein at least one of the first member, the second member, and the covering layer include a foam material.

6. The cushion assembly of claim 5, wherein the first member has an indentation force deflection characteristic between approximately 25 lb to 30 lb IFD.

7. The cushion assembly of claim 1, wherein the covering layer spans continuously across each of the first, second, and third members in a direction generally transverse to the thickness direction.

8. The cushion assembly of claim 1, wherein at least one of the first and second members continuously extends between a first one of the transverse sides and a second one of the transverse sides of the cushion assembly, the first and second ones of the transverse sides extending generally transverse to the forward area of the cushion assembly.

9. The cushion assembly of claim 1, wherein each of the first and second members is elongate and rectangular, and has a substantially straight axis extending in a side-to-side direction.

10. The cushion assembly of claim 1, wherein the covering layer includes at least one upper covering layer and at least one lower covering layer, and wherein the core layer is disposed between the at least one upper covering layer and the at least one lower covering layer.

11. The cushion assembly of claim 1, further comprising a jacket, the covering layer and the core layer being encapsulated within the jacket.

* * * * *